US007380386B2

(12) United States Patent
Spatafora

(10) Patent No.: US 7,380,386 B2
(45) Date of Patent: Jun. 3, 2008

(54) METHOD OF MAKING A BRAND CHANGE ON AN AUTOMATIC PRODUCTION SYSTEM FOR PROCESSING TOBACCO ARTICLES

(75) Inventor: Mario Spatafora, Granarolo (IT)

(73) Assignee: G.D Societa' per Azioni, Bologna (IT)

( * ) Notice: Subject to any disclaimer, the term of this patent is extended or adjusted under 35 U.S.C. 154(b) by 69 days.

(21) Appl. No.: 11/416,087

(22) Filed: May 3, 2006

(65) Prior Publication Data

US 2007/0144546 A1 Jun. 28, 2007

(30) Foreign Application Priority Data

May 6, 2005 (IT) ..... BO2005A0328

(51) Int. Cl.
*B65B 57/02* (2006.01)
*B65B 19/04* (2006.01)

(52) U.S. Cl. ..... 53/64; 53/53; 53/444; 53/466

(58) Field of Classification Search ..... 53/53, 53/64, 148, 444, 466, 586; 382/143
See application file for complete search history.

(56) References Cited

U.S. PATENT DOCUMENTS 4,738,073 A * 4/1988 Mattei et al. ..... 53/53
4,972,494 A * 11/1990 White et al. ..... 382/143
5,056,294 A 10/1991 Focke
5,189,708 A * 2/1993 Cox et al. ..... 382/143
5,412,926 A * 5/1995 Focke ..... 53/53
5,664,026 A * 9/1997 Neri et al. ..... 382/143
5,877,506 A * 3/1999 Focke et al. ..... 53/53
6,062,000 A 5/2000 Focke et al.
6,158,193 A * 12/2000 Focke et al. ..... 53/53
6,173,551 B1 * 1/2001 Bowman et al. ..... 53/64
6,205,237 B1 * 3/2001 Focke et al. ..... 382/143
6,308,492 B1 10/2001 Focke et al.
6,516,811 B1 2/2003 Focke et al.
6,751,934 B2 * 6/2004 Focke et al. ..... 53/64
2002/0095912 A1 7/2002 Focke et al.

FOREIGN PATENT DOCUMENTS

EP 0 963 913 A1 12/1999
EP 1 457 121 A2 9/2004

* cited by examiner

*Primary Examiner*—Louis Huynh
(74) *Attorney, Agent, or Firm*—Oblon, Spivak, McClelland, Maier & Neustadt, P.C.

(57) ABSTRACT

A method of making a brand change, on an automatic production system for processing tobacco articles and which produces a first product from first materials; the method has the steps of: stopping the automatic production system once production of the first product is completed; feeding second materials onto the automatic production system; restarting the automatic production system to commence production of a second product from the second materials; checking all the second products in a first lot to ensure each second product in the first lot conforms with production specifications; externally marking each second product in the first lot conforming with production specifications; and generating a pass signal when a given number of consecutive second products conforming with production specifications is produced.

20 Claims, 1 Drawing Sheet

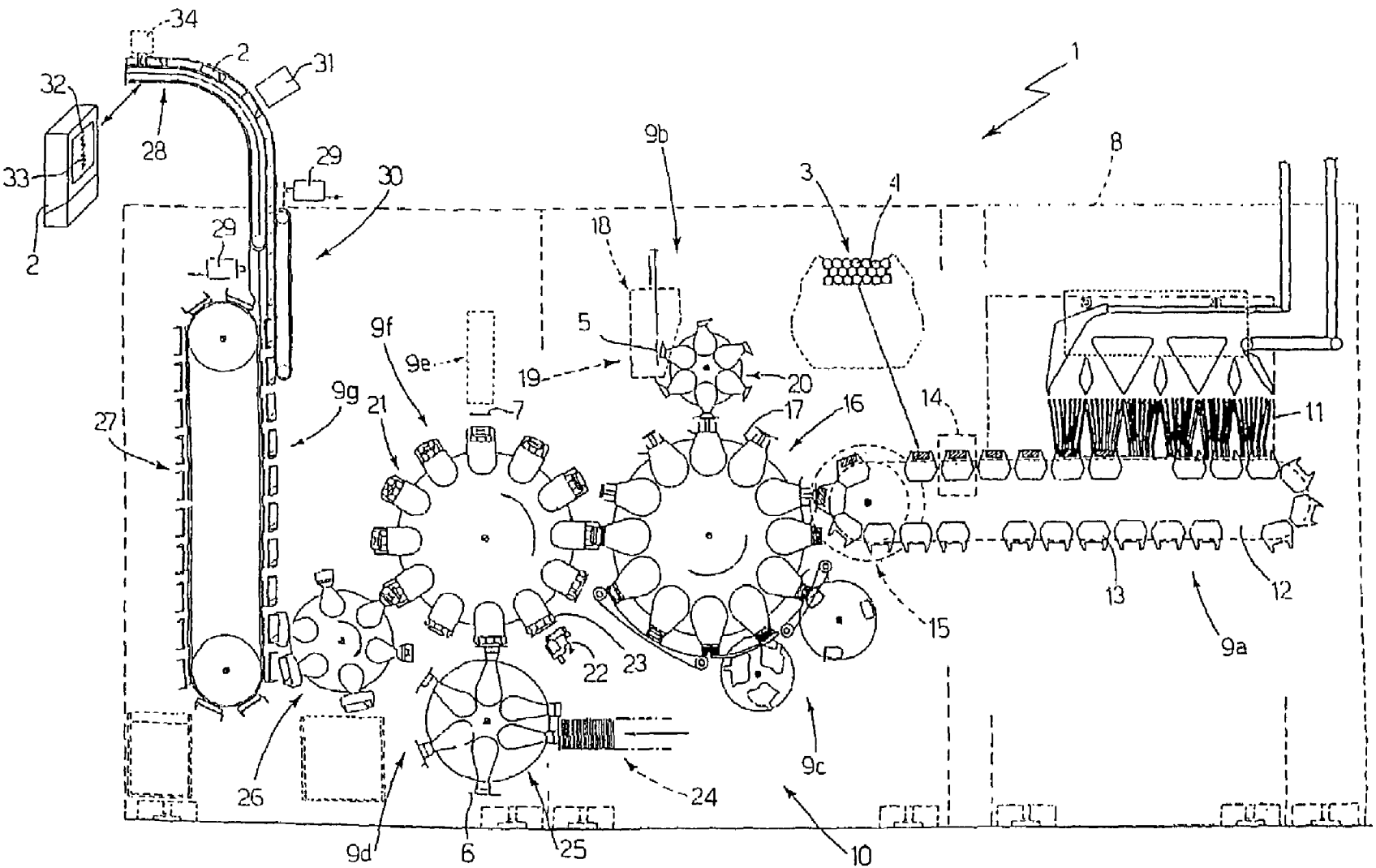
1
2
3
4
5
6
7
8
9a
9b
9c
9d
9e
9f
9g
10
11
12
13
14
15
16
17
18
19
20
21
22
23
24
25
26
27
28
29
30
31
32
33
34

METHOD OF MAKING A BRAND CHANGE ON AN AUTOMATIC PRODUCTION SYSTEM FOR PROCESSING TOBACCO ARTICLES

The present invention relates to a method of making a brand change on an automatic production system for processing tobacco articles.

The present invention may be used to advantage on an automatic cigarette packing machine, to which the following description refers purely by way of example.

BACKGROUND OF THE INVENTION

In the past, a cigarette packing machine was assigned packets of cigarettes of one given brand, which was produced, unchanged, for a long period of time. In recent times, however, attempts have been made to introduce a so-called "just in time" production policy, whereby the brand of the packets of cigarettes produced on a given cigarette packing machine is changed frequently to adapt in real time to market demand and so prevent storage.

On a cigarette packing machine, a brand change involves clearing the packing line of the packing machine completely of the packets of cigarettes currently being produced; shutting down the packing machine; and removing any leftover packing materials from the packing machine. At this point, the necessary settings on the packing machine are made (and, possibly, any assemblies incompatible with the new brand are changed); the new packing materials are fed onto the machine; and the packing machine is started up again to commence production of the new brand of packets of cigarettes.

Experience has shown that, when commencing production of a new brand of packets of cigarettes, manual checking is required of a given number of first items (e.g. the first two hundred packets of cigarettes produced) to detect any errors in feeding on the new packing material and/or in removing the old packing materials. And only then can production of the new brand of packets of cigarettes continue at full speed for supply to the marketing network. Manual checking of this sort, however, involves considerable cost, by requiring the assistance of one or more operators, and shutdown in production of the new brand throughout.

US2002095912A1 discloses a process for producing cigarette packs. The procedure for carrying out a product changeover is such that the entire production and packaging installation is largely emptied; in the region of a film packer and of a following multipacker, subassemblies for producing web connections are controlled such that a last cigarette pack of the old configuration is assigned to a last cigarette multipack and this is then separated out.

US6308492B1 discloses a process and an apparatus for producing packs, in particular cigarette packs; a change in the type of pack makes it necessary for the operators carefully to provide the correct packaging material assigned to the new type of pack. In practice, this change of material often takes place incorrectly; the invention avoid errors when the type of pack is changed in that markings, which are assigned to packaging material of different designs and are provided on the packaging material and/or the carrier thereof, in particular on a core of the reel, and/or the pack, are used to identify the packaging material and to check it for correct assignment in relation to the type of pack which is to be produced.

SUMMARY OF THE INVENTION

It is an object of the present invention to provide a method of making a brand change on an automatic production system for processing tobacco articles, designed to eliminate the above drawbacks, and which, in particular, is cheap and easy to implement.

According to the present invention, there is provided a method of making a brand change on an automatic production system for processing tobacco articles, as claimed in the attached Claims.

BRIEF DESCRIPTION OF THE DRAWING

A non-limiting embodiment of the present invention will be described by way of example with reference to the accompanying drawing, which shows a schematic front elevation of an automatic cigarette packing machine implementing the brand-change method according to the present invention.

DETAILED DESCRIPTION OF THE INVENTION

Number 1 in the accompanying drawing indicates as a whole an automatic machine for producing rigid packets 2 of cigarettes, each of which comprises an orderly group 3 of cigarettes 4 wrapped in a sheet 5 of foil inner packing material; and a blank 6 which is folded about group 3 of cigarettes 4, wrapped in sheet 5 of inner packing material, to define a hinged-lid container. A U-folded collar 7 is inserted inside an open top end of the container to engage an inner surface of the lid when the lid is in a closed position.

Machine 1 is of the type marketed by G.D. by the trade name "H1000", and comprises a frame 8, shown by a dash line in FIG. 1, supporting a number of work stations 9 located along a production line 10, and each of which comprises a respective number of operating devices. More specifically, machine 1 comprises seven work stations 9: a station 9*a* for forming groups 3 of cigarettes 4; a station 9*b* for supplying foil sheets 5; a station 9*c* for folding foil sheets 5 about groups 3 of cigarettes 4; a station 9*d* for supplying blanks 6; a station 9*e* for supplying collars 7; a station 9*f* for folding blanks 6 and collars 7 about groups 3 of cigarettes 4 and on top of the previously folded foil sheets 5; and a station 9*g* for completing and drying packets 2.

The following is a description of the main operating devices of each work station 9. Needless to say, each work station 9 actually comprises additional operating devices which cannot be detailed in the attached schematic drawing.

Station 9*a*, for forming groups 3 of cigarettes 4, comprises a hopper 11 having a number of outlets for supplying groups 3 of cigarettes 4; a forming conveyor 12 having trains of pockets 13, each of which pockets receives a group 3 of cigarettes 4 from hopper 11; optical control devices 14; and a transfer wheel 15.

Station 9*c*, for folding foil sheets 5 about groups 3 of cigarettes, comprises a packing wheel 16 having a number of folding heads 17, each of which receives a group 3 of cigarettes from transfer wheel 15, receives a foil sheet 5 from supply station 9*b*, and folds foil sheet 5 about group 3 with the aid of external folding members.

Station 9*b*, for supplying sheets 5 of foil packing material, comprises a feed conveyor 18 for feeding forward a continuous strip of foil; a cutting device 19 for cutting foil sheets 5 off the continuous strip; and a feed wheel 20 for feeding foil sheets 5 to packing wheel 16.

Station 9*f*, for folding blanks 6 and collars 7 about groups 3 of cigarettes 4 and on top of the previously folded foil sheets 5, comprises a packing wheel 21 fitted with a spray gumming unit 22 and having a number of folding heads 23. Each folding head 23 receives a blank 6 from supply station 9*d*, receives a group 3 of cigarettes 4 from packing wheel 16, receives a collar 7 from supply station 9*e*, and folds blank 6, together with collar 7, about group 3 of cigarettes with the aid of external folding members. On each blank 6 carried by a folding head 23, gumming unit 22 deposits a number of spots or areas of thermoplastic (or hot-melt) glue before blank 6 is folded about group 3 of cigarettes 4.

Station 9*d*, for supplying blanks 6, comprises a horizontal hopper 24 containing a stack of blanks 6; and a feed wheel 25 for withdrawing and feeding each blank 6 from hopper 24 to a folding head 23 on packing wheel 21.

Supply station 9*e* is shown purely schematically, and is substantially similar to supply station 9*b*.

Finally, station 9*g*, for drying packets 2 of cigarettes, comprises a transfer and reject wheel 26; a drying conveyor 27; an output conveyor 28; and optical control devices 29 defining a control station 30. A marking device 31 is located immediately downstream from control station 30 and along output conveyor 28, to apply a visible external marker to the packets 2 in transit.

When operating normally, packing machine 1 as described above processes materials 4, 5, 6 and 7 (more specifically, cigarettes 4, sheets 5 of inner packing material, blanks 6, and collars 7) to form packets 2 of cigarettes of given aesthetic/functional characteristics. And, by varying the type of some or all of materials 4, 5, 6, 7, the type of packets 2 of cigarettes produced on packing machine 1 can be varied accordingly.

The following is a detailed description of the brand-change operations performed to switch from production of first packets 2 of cigarettes to production of second packets 2 of cigarettes differing in aesthetic and/or functional characteristics from first packets 2.

When production of first packets 2 of cigarettes is completed, i.e. when the required number of first packets 2 of cigarettes has been produced, packing machine 1 is "smart stopped" to clear production line 10 so that no incomplete first packets 2 of cigarettes are left on production line 10. "Smart stopping" of a cigarette packing machine is known, and comprises gradually cutting off supply of materials 4, 5, 6 and 7 to complete all the first packets 2 of cigarettes on production line 10. An example of a "smart stop" of a cigarette packing machine is given in Patents GB1384722A and US3805477A1.

Once packing machine 1 is stopped, any leftover first packing materials 4, 5, 6, 7 are removed from packing machine 1. In a preferred embodiment, when producing first packets 2 of cigarettes 4, packing machine 1 is supplied with a given calculated quantity of first packing materials 4, 5, 6, 7, so that, by the time production of first packets 2 of cigarettes is completed, all the first packing materials 4, 5, 6, 7 on packing machine 1 have been used up. Consequently, removal of leftover first packing materials 4, 5, 6, 7 should not be necessary, in that, by the time production of first packets 2 of cigarettes is completed, there should be no leftover first packing materials 4, 5, 6, 7 on packing machine 1. One example of a cigarette packing system control method, which provides for supplying a controlled quantity of packing materials, is described in Patent Application W02004062395A1.

Once cleared of all the first packets 2 of cigarettes and first packing materials 4, 5, 6, 7 as described above, packing machine 1 is supplied with second packing materials 4, 5, 6, 7 to produce second packets 2 of cigarettes. Before the second packing materials 4, 5, 6, 7 are supplied, the operating devices may, if necessary, be adjusted or changed to adapt to the new brand. Obviously, if a first packing material 4, 5, 6, 7 is identical to the corresponding second packing material 4, 5, 6, 7, it need not be removed.

At this point, packing machine 1 is started up again to commence production of second packets 2 of cigarettes using second packing materials 4, 5, 6, 7.

Once production of second packets 2 of cigarettes is started up, all the second packets 2 of cigarettes in a first lot are checked at control station 30 and by other control devices (e.g. optical control devices 14) along production line 10, to ensure each second packet of cigarettes 2 in the first lot conforms with production specifications. In particular, a check is made to ensure each second packet 2 of cigarettes in the first lot is made up exclusively of second packing materials 4, 5, 6, 7 and not a combination of first and second packing materials 4, 5, 6, 7.

Each second packet 2 of cigarettes conforming with production specifications in the first lot is marked externally by marking device 31, which applies an adhesive label 32 with an identification code 33 to the outer surface of the accepted second packet 2 of cigarettes. Identification code 33, for example, may comprise a set of bars readable optically by a bar reader, and/or an alphanumeric sequence. In an alternative embodiment, each accepted second packet 2 of cigarettes in the first lot is marked externally by impressing (e.g. ink-jet printing or laser inscribing) an identification code 33 on the outer surface of the accepted second packet 2 of cigarettes. In a further embodiment, each accepted second packet 2 of cigarettes in the first lot is marked externally by spraying a coloured mark on the outer surface of the accepted second packet 2 of cigarettes.

Once a given number of consecutive second packets 2 of cigarettes conforming with production specifications is produced, a pass signal approving the first lot is generated to terminate the first lot and commence normal production of second packet 2. Obviously, once the first lot is terminated, marking of the accepted second packets 2 of cigarettes is discontinued, and the type of check made of each second packet 2 of cigarettes may be changed, it no longer being strictly necessary to ensure each second packet 2 of cigarettes in the first lot is made up exclusively of second packing materials 4, 5, 6, 7 as opposed to a combination of first and second packing materials 4, 5, 6, 7. In this connection, second packets 2 of cigarettes in the first lot may also be checked at control station 30 by a special control device 29 used exclusively for checking first lots of packets 2 of cigarettes, and for ensuring each second packet 2 of cigarettes in the first lot is made up exclusively of second packing materials 4, 5, 6, 7 as opposed to a combination of first and second packing materials 4, 5, 6, 7.

In the above embodiment, the pass signal is generated once a given number of consecutive second packets 2 of cigarettes conforming with production specifications is produced; in an alternative embodiment, the pass signal is generated once a given number of even non-consecutive second packets 2 of cigarettes conforming with production specifications is produced.

In one embodiment shown by a dash line, an optical counting device 34 is located downstream from marking device 31, along output conveyor 28, to detect the external marker on the outer surface of second packets 2 of cigarettes, and to count the number of externally marked second packets 2 of cigarettes in the first lot. The count by counting device 34 is used to generate the pass signal.

In a preferred embodiment, packing machine 1 is operated at a slower speed when producing second packets 2 of cigarettes in the first lot, to allow more time for each check and so achieve greater checking precision.

The data acquired by control station 30 when checking each accepted second packet 2 of cigarettes in the first lot may be memorized permanently and associated with the second packet 2 of cigarettes by means of identification code 33 applied to second packet 2 of cigarettes, thus making it possible, even afterwards, to trace the parameters determining acceptance of a second packet 2 of cigarettes.

The above brand-change method has numerous advantages, by enabling all the necessary brand-change conformance checks to be performed automatically, and above all by providing tangible, easy-to-file proof that the checks have been made, in the form of accepted, externally marked second packets 2 of cigarettes in the first lot. Given its many advantages, the above brand-change method may also be used to advantage on other types of automatic systems for processing tobacco articles, such as a cellophaning machine for producing a transparent plastic overwrapping about packets 2 of cigarettes, a cartoning machine for producing cartons of packets 2 of cigarettes, or a cigarette manufacturing and packing system comprising a number of successive automatic machines.

The invention claimed is:

1. A method of making a brand change on an automatic production system (1) for processing tobacco articles and which produces a first product (2) from first materials (4, 5, 6, 7) on a production line (10) comprising a succession of work stations (9); the method comprising the steps of:

completing production of the first product (2) to clear the production line (10) of the automatic production system (1);

stopping the automatic production system (1) once production of the first product (2) is completed;

feeding second materials (4, 5, 6, 7) onto the automatic production system (1); and restarting the automatic production system (1) to commence production of a second product (2) from the second materials (4, 5, 6, 7);

the method is characterized by comprising the further steps of:

checking all the second products (2) in a first lot by means of at least one control station (30) of the automatic production system (1), to ensure each second product (2) in the first lot conforms with production specifications;

marking each second product (2) in the first lot conforming with production specifications; and generating a pass signal when a given number of second products (2) conforming with production specifications is produced.

2. A method as claimed in claim 1, wherein the pass signal is generated when a given number of consecutive second products (2) conforming with production specifications is produced.

3. A method as claimed in claim 1, wherein the pass signal is generated when a given number of even non-consecutive second products (2) conforming with production specifications is produced.

4. A method as claimed in claim 1, wherein the pass signal terminates the first lot and starts normal production of the second products (2).

5. A method as claimed in claim 4, and comprising the further step of supplying the automatic production system (1) with a given calculated quantity of first materials (4, 5, 6, 7) when producing the first product (2), so that, by the time production of the first product (2) is completed, all the first materials (4, 5, 6, 7) on the automatic production system (1) have been used up.

6. A method as claimed in claim 4, and comprising the further step of removing any leftover first materials (4, 5, 6, 7) from the automatic production system (1) prior to supplying the second materials (4, 5, 6, 7).

7. A method as claimed in claim 1, wherein the step of marking each conforming second product (2) in the first lot comprises applying an adhesive label (32) to the outer surface of the conforming second product (2).

8. A method as claimed in claim 7, wherein each label (32) has an identification code (33).

9. A method as claimed in claim 1, wherein the step of marking each conforming second product (2) in the first lot comprises impressing an identification code (33) on the outer surface of the conforming second product (2).

10. A method as claimed in claim 1, wherein the step of marking each conforming second product (2) in the first lot comprises applying a coloured mark on the outer surface of the second product (2).

11. A method as claimed in claim 1, wherein, at the control station (30), the second products (2) in the first lot are also checked by a special control device (29) used solely for checking first lots of products (2).

12. A method as claimed in claim 1, wherein the type of check made of each second product (2) is changed once checking of the first lot is completed.

13. A method as claimed in claim 1, wherein the automatic production system (1) is operated at a slower speed to produce the second products (2) in the first lot.

14. A method as claimed in claim 1, wherein the step of marking each conforming second product (2) in the first lot comprises applying an identification code (33) on the outer surface of the conforming second product (2); and the data acquired by the control station (30), when checking each conforming second product (2) in the first lot, is memorized permanently and associated with the conforming second product (2) by means of the identification code (33) applied to the second product (2).

15. A method as claimed in claim 1, wherein the number of marked second products (2) in the first lot is counted by a counting device (34) which detects the presence of the marking; and the count by the counting device (34) is used to generate the pass signal.

16. A method as claimed in claim 15, wherein the counting device (34) is optical, and detects the presence of external markings.

17. A method as claimed in claim 1, wherein the automatic production system (1) folds at least one sheet (5, 6) of packing material about a group (3) of tobacco articles (4).

18. A method as claimed in claim 17, wherein the automatic production system (1) is a packing machine for producing packets (2) of cigarettes.

19. A method as claimed in claim 17, wherein the automatic production system (1) is a cellophaning machine for producing a transparent plastic overwrapping about packets (2) of cigarettes.

20. A method as claimed in claim 17, wherein the automatic production system (1) is a cartoning machine for producing cartons of packets (2) of cigarettes.

* * * * *